United States Patent [19]

Gatley

[11] 4,220,288

[45] Sep. 2, 1980

[54] MILL ROLLER CONTROLLING APPARATUS

[75] Inventor: Thomas W. Gatley, North Bundaberg, Australia

[73] Assignee: The Bundaberg Foundry Company Limited, Queensland, Australia

[21] Appl. No.: 966,391

[22] Filed: Dec. 4, 1978

[51] Int. Cl.[3] ..... B02C 4/32

[52] U.S. Cl. ..... 241/37; 241/101.2; 241/231

[58] Field of Search ..... 92/66, 76; 100/169, 100/170; 425/363; 72/240, 243; 241/230-234, 37, 101.2

[56] References Cited

U.S. PATENT DOCUMENTS

| | | | |
|---|---|---|---|
| 3,099,406 | 7/1963 | Kautz | 241/231 X |
| 3,445,070 | 5/1969 | Verdier | 241/231 X |

FOREIGN PATENT DOCUMENTS

| | | | |
|---|---|---|---|
| 662825 | 5/1963 | Canada | 241/231 |

*Primary Examiner*—Mark Rosenbaum
*Attorney, Agent, or Firm*—D. Paul Weaver

[57] ABSTRACT

Mill roller controlling apparatus including a mill roller, a pair of support hydraulic ram assemblies supporting each end of the mill roller and an auxiliary hydraulic ram assembly to which each of the support ram assemblies are connected in closed hydraulic circuit. The apparatus is characterized by the provision of control means such as a gas accumulator which maintains constant pressure in the auxiliary ram assembly whereby on movement of the cylinder or piston of the auxiliary ram assembly, each end of the mill roller will move upwardly or downwardly in unison.

9 Claims, 2 Drawing Figures

MILL ROLLER CONTROLLING APPARATUS

BACKGROUND OF THE INVENTION

This invention relates to mill roller controlling apparatus and particularly apparatus for controlling mill rollers used for crushing and feeding purposes in mills.

The invention is primarily adapted to cane crushing mills, and this will be the sole application to which the invention will be hereinafter described. However, it will be appreciated that this is not the only application of the invention and hence the invention should not be limited to this example application.

Normally, a cane crushing mill comprises a group of three crushing rollers with two lower rollers being located closely adjacent to one another and an upper roller located above the mid region of the two lower rollers. When material to be crushed is fed into these rollers, it is crushed between the rotating exterior surfaces of the two lower rollers and the upper roller.

In regard to the group of three crushing rollers, it is common practice to have at least two of these rollers supported by hydraulic cylinders. In relation to the upper roller, this may be supported by a hydraulic cylinder allowing the upper roller to "float" against a preset hydraulic load. A hydraulic circuit containing an accumulator maintains a constant pressure in the cylinder. One of the lower rollers may also be supported by a hydraulic cylinder which is usually removable.

It is usual practice for all hydraulically loaded mill rollers to be loaded or supported at each end by two independent hydraulic ram assemblies operating at a preset constant pressure. A foreign body or uneven feed passing through the mill will produce a reaction at each end and this will cause one or both rams to move. The roller can therefore tilt with its longitudinal axes parallel to its set position or it can tilt in either direction. This has an undesirable effect on the pinion because the pinion also becomes misaligned in relation to its mating pinion and point loading occurs at one end of the pinion or the other. This will result in uneven pinion wear and eventually cause tooth breakage from fatigue. It is apparent that, at high torques, this failure can occur in relatively new pinions.

Mill engineers have attempted to solve this problem by adjusting the hydraulic pressure on each cylinder so that the roller will lift evenly. The configuration of the roller, i.e. supported between two bearings, and with an overhung pinion at the power input end, becomes a major problem in achieving an even lift. The almost horizontal reaction on the top roller pinion causes a large force between the vertical face of the brass bearing and the face of the bearing opening in the mill cheek. This force and therefore the resulting friction force is many times greater at the pinion end than at the other end. Added to this, is the almost vertical pinion reaction tending to lift the end of the roller at the pinion end. It is therefore difficult to strike a balance in order to achieve even roller lift and more difficult to maintain this condition.

SUMMARY OF THE INVENTION

It is therefore an object of the invention to provide a controlling apparatus for a mill roller which overcomes or minimizes these problems.

The invention provides a mill roller controlling apparatus including:

a mill roller;

a pair of support hydraulic ram assemblies supporting each end of the mill roller;

an auxiliary hydraulic ram assembly to which each of the support ram assemblies are connected in closed hydraulic circuit; and control means to maintain constant pressure in said auxiliary ram assembly whereby on movement of the cylinder or piston of the auxiliary ram assembly each end of the mill roller will move upwardly or downwardly in unison.

Preferably the movable component of the auxiliary ram assembly is the piston with the auxiliary cylinder being fixed. In this arrangement the auxiliary piston may be movable between a top and bottom chamber located in the auxiliary cylinder. The auxiliary piston is desirably stepped or otherwise formed so as to provide an intermediate chamber between the top and bottom chambers. The top chamber is connected to one of the support hydraulic ram assemblies and the intermediate chamber is connected to the other. The bottom chamber is then subject to the control means and thereby is maintained at constant pressure.

The control means for maintaining constant pressure in the auxiliary ram may be of any appropriate type but is suitably a gas accumulator.

BRIEF DESCRIPTION OF THE DRAWINGS

Reference is now made to a preferred embodiment of the invention as illustrated in the appended drawings wherein.

DETAILED DESCRIPTION OF THE PREFERRED EMBODIMENT

Figures 1, 2:
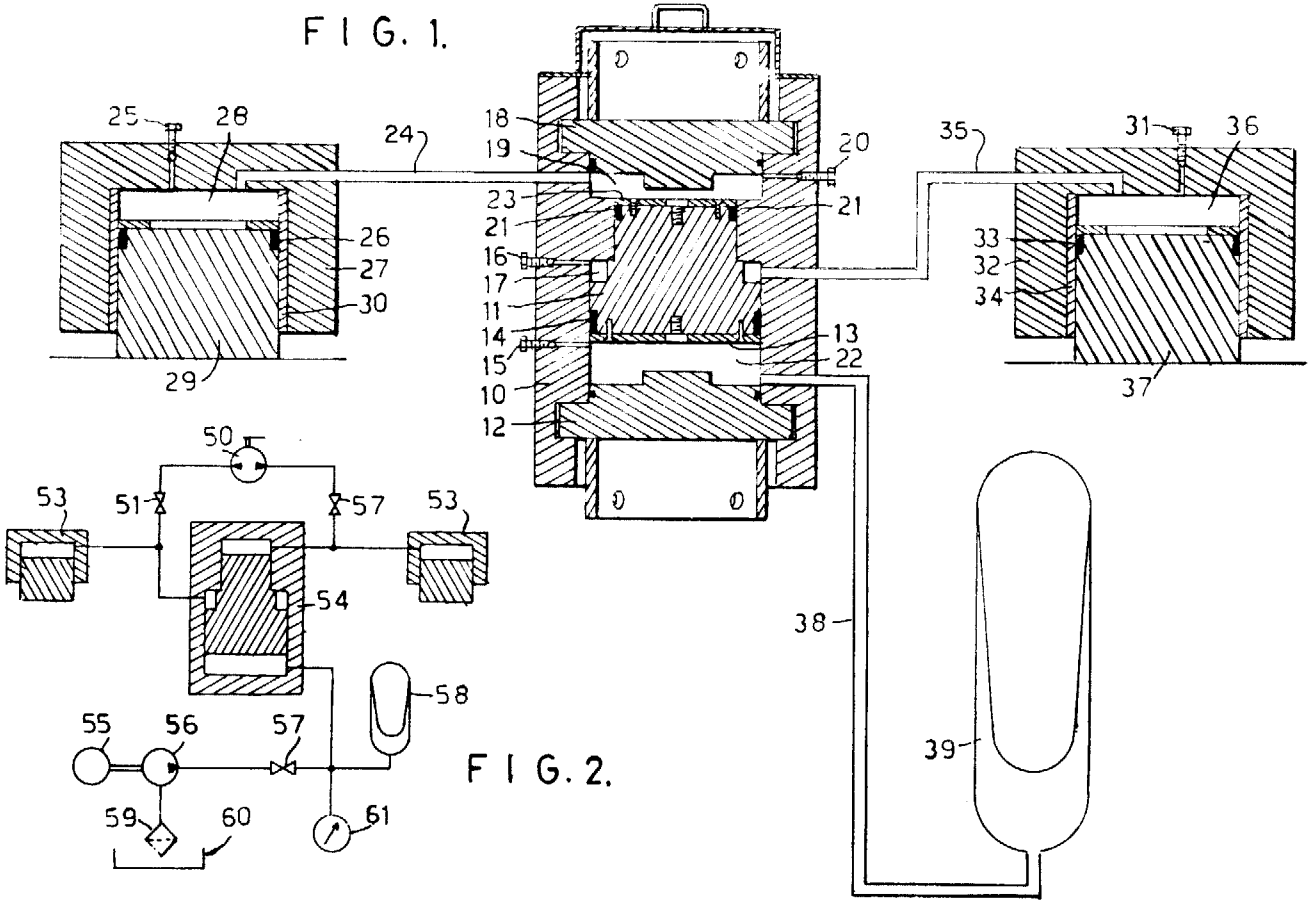
FIG. 1 is a diagrammatic drawing of the mill roller controlling apparatus of the invention.
FIG. 2 is a diagrammatic view of the hydraulic circuit between the auxiliary hydraulic ram assembly and the pair of support hydraulic ram assemblies.

In FIG. 1, there is shown an auxiliary ram assembly comprising auxiliary piston 11 and auxiliary cylinder 10. The piston 11 is movable between a top chamber 19 and bottom chamber 22 and there is provided an intermediate annular chamber 17. The piston 11 is caused to move by fluid fed into chambers 19 and 17 from each of the support hydraulic ram assemblies which are connected to chambers 19 and 17 by conduits 24 and 35 respectively.

The piston 11 comprises retaining plates 13 and 23 at its top and bottom end, and lower sliding seals 14 and upper sliding seals 21.

The cylinder 10 comprises air bleed screws 15, 16 and 20, and is also provided with a cylinder head 18 and cylinder base 12.

Conduit 24 connects one hydraulic support ram assembly to chamber 19. This support ram assembly includes fixed piston 29 and movable cylinder 27. Because of the upward or downward movement of the cylinder 27 the conduit 24 is in the form of a flexible hose. There is also provided liner 30, sliding seals 26 and air bleed screw 25. The space 28 is of variable volume depending on the movement of cylinder 27 relative to piston 29.

Conduit 35 connects the other hydraulic assembly to chamber 17 and this includes fixed piston 37 and movable cylinder 32. Again because of the upward or downward movement of cylinder 32 the conduit 35 is in the form of a flexible hose. There is also provided liner 34, sliding seals 33, and air bleed screw 31. The space 36 is of variable volume dependent on the movement of cylinder 32 relative to piston 37.

There is also shown gas accumulator 39 connecting with bottom chamber 22 via conduit 38.

In FIG. 2 there is shown a hydraulic circuit interconnecting each support ram assembly and the auxiliary ram assembly. This includes a hand operated hydraulic pump 50, needle valves 51, support ram assemblies 53, auxiliary ram assembly 54, electric motor 55, hydraulic pump 56, needle valve 57, gas accumulator 58, filter 59, reservoir tank 60 and pressure gauge 61.

In operation of the invention upon an uneven load occurring to the mill roller, with for example a greater load being applied at the end support by the support ram assembly having piston 29 and cylinder 27 than at the other end, this will cause downward movement of cylinder 27 relative to piston 29. This in turn will cause fluid to flow through conduit 24 and into chamber 19 and thereby cause downward movement of auxiliary piston 11. This will result in fluid being caused to flow into intermediate chamber 17, resulting in downward movement of cylinder 32 relative to fixed piston 37. It will be appreciated that the reverse would happen if the greater load was applied at the end supported by the support ram assembly having piston 37 and cylinder 32.

From the above discussed, it will be appreciated by the provision of the auxiliary hydraulic ram assembly which has two hydraulic circuits with each support ram which are isolated from one another, each end of the mill roller supported by the two support rams will rise or fall in unison, and the mill roller will not tilt longitudinally.

The invention inherently uses the imcompressibility of liquids such as mineral oil to eliminate the differential movement of the two support rams. Both rams become slaves to the equalizing function of the auxiliary ram which averages the force on each of two support rams and moves accordingly. The lower chamber 22 is connected to the accumulator 39 which maintains a constant pre-set pressure. The chambers 17 and 19 are isolated from one another and from the chamber 22 by seals. These seals do not have an arduous task since the two hydraulic circuits with each support ram and the circuit with the gas accumulator are maintained at the same pressure.

It is preferred that the working surface of the two support rams (i.e. that surface of the movable component of the rams, which may be the piston or the cylinder which contacts the fluid) be substantially the same in area. However, this is not essential as if these areas are different, suitable modifications can be made to the auxiliary ram (e.g. by providing that the working surface of the auxiliary piston 11 in chamber 17 is a ratio of the working surface of piston 11 in chamber 19).

However, it is preferred that the respective working surfaces exposed to fluid in chambers 17 and 19 be the same in area.

In the preferred embodiment described in FIGS. 1-2 above, each of chambers 17 and 19 has a working surface area one-half the area of the working surface of each support ram. The working surface of chamber 22 has an area equal to the working surface of each of the support rams.

The force on each support ram causes a force on each of the working surfaces exposed to chambers 17 and 19 of the auxiliary ram which is pressure multiplied by area. In the auxiliary ram referred to above, the force on the respective working surfaces exposed to chambers 17 and 19 are one half the force applied to each of the support rams. These two separate forces applied to the auxiliary ram combine to give a resultant downwards force on the auxiliary ram and if this is sufficiently high to overcome the force applied to the undersurface of the auxiliary ram, the ram will move downwards. A downwards movement on the auxiliary ram will allow hydraulic fluid to flow from each support ram and these rams will also move.

The increase or decrease in volume in chambers 17 and 19 are always the same hence the movement of the two support rams is always the same.

A massive failure of the seals in one of the support rams could require that the mill roller be operated as a fixed roller until the ram packing was replaced. In this respect the situation is the same as that existing in normal mills.

A slight leakage in oil past the seals in one of the support cylinders would reduce the volume of oil in that closed circuit and one support ram would constantly lag the other, i.e. the roller would be constantly tilted. This would become obvious on the lift indicator and would be easily rectified by adding oil under pressure to the closed circuit by means of a hand pump. The amount of oil required would be apparent again from the lift indicators. This could and probably would be better done with the mill in operation.

The auxiliary ram does not have to be mounted on the mill but simply in some convenient position, close to the mill. The auxiliary ram has been designed such that some of the parts are standard items of equipment in normal mill hydraulics. The auxiliary ram may be incorporated into a new mill as part of the mill or the auxiliary ram assembly may be made and connected to the existing support rams of an established mill.

The invention therefore also includes within its scope an auxiliary hydraulic ram assembly for connection to two support hydraulic ram assemblies which both support respective ends of a mill roller, said auxiliary hydraulic ram assembly including a piston movable in the auxiliary cylinder between a top chamber and a bottom chamber, said auxiliary piston being stepped or otherwise formed so as to define an intermediate chamber between the said bottom and top chambers, whereby in use the bottom chamber is maintained at constant pressure and the intermediate and the top chamber are each connected to both support hydraulic ram assemblies.

The invention also includes within its scope a hydraulic circuit including:

- a pair of support ram assemblies which each support respective ends of a mill roller;
- an auxiliary ram assembly having a movable component which moves between a top chamber and a bottom chamber of the assembly, said assembly also including an intermediate chamber between the top and bottom chambers;
- a first fluid conduit interconnecting one support ram assembly with the top chamber of the auxiliary ram assembly;
- a second fluid conduit interconnecting the other support ram assembly with the intermediate chamber of the auxiliary ram assembly;
- a third fluid conduit interconnecting the bottom chamber with means for maintaining a constant pressure in said bottom chamber.

I claim:

1. Apparatus for controlling movements of a crushing mill roller or the like comprising a pair of supporting hydraulic rams supporting opposite ends of a mill roller and each having a variable volume chamber subject to variations in fluid pressure, an auxiliary hydraulic ram assembly common to said hydraulic rams and having spaced cylinder heads and a single piston between the cylinder heads, said auxiliary hydraulic ram having separated chambers on opposite sides of said piston and an intermediate chamber between and isolated from said separated chambers, the intermediate chamber being in part volumetrically defined by surfaces of said piston, fluid pressure means connected in communicating relationship with one of said separated chambers of the auxiliary hydraulic ram to maintain a constant pressure in such chamber, and means connecting the variable volume chamber of one supporting hydraulic ram in communicating relationship with the other separated chamber of the auxiliary ram and connecting the variable volume chamber of the other supporting hydraulic ram in communicating relationship with the intermediate chamber of the auxiliary ram, whereby movement of said single piston of the auxiliary ram responsive to pressure changes in either of said separated chambers of the auxiliary ram will cause displacement of said supporting hydraulic rams in unison.

2. Apparatus as defined in claim 1, and said single piston of the auxiliary hydraulic ram being a stepped piston with the stepped surface of the piston defining with opposing surfaces of the auxiliary ram cylinder said intermediate chamber, opposite end faces of the single piston in part defining said separated chambers of the auxiliary hydraulic ram, and fluid sealing means on said single piston to maintain the isolation of said separated chambers from each other and from the intermediate chamber of the auxiliary hydraulic ram.

3. Apparatus as defined in claim 1, and said fluid pressure means to maintain a constant pressure in such chamber comprising a gas accumulator.

4. Apparatus as defined in claim 1, and the effective working areas of the supporting hydraulic rams being equal.

5. Apparatus as defined in claim 4, and the effective working areas of the intermediate chamber and one of the separated chambers of the auxiliary hydraulic ram being equal.

6. Apparatus as defined in claim 5, and the effective working areas of the last-named two chambers of the auxiliary hydraulic ram are each approximately one-half the area of the effective working area of each supporting hydraulic ram.

7. Apparatus as defined in claim 1, and said last-named means comprising first and second isolated fluid conduits.

8. For use in a crushing roller mill or the like, an auxiliary hydraulic ram operatively associated with a pair of mill roller supporting hydraulic rams each having a variable volume chamber subject to fluctuations in fluid pressure, the auxiliary hydraulic ram having a single piston and having separated chambers on opposite sides of the piston and an intermediate chamber isolated from the separated chambers, fluid pressure means connected in communication with one of said separated chambers to maintain a constant pressure therein, and means connecting the variable volume chamber of one supporting hydraulic ram in communication with the other separated chamber and connecting the variable volume chamber of the other supporting hydraulic ram in communication with said intermediate chamber, whereby movement of said single piston responsive to a pressure change in either separated chamber of the auxiliary hydraulic ram produces displacement of said supporting hydraulic rams in unison.

9. The apparatus as defined in claim 8, and a first fluid conduit interconnecting said fluid pressure means and said one separated chamber, a second fluid conduit interconnecting the first-named variable volume chamber with said other separated chamber, and a third fluid conduit interconnecting the other variable volume chamber with said intermediate chamber.

* * * * *